United States Patent [19]

Ames et al.

[11] Patent Number: 4,904,313

[45] Date of Patent: Feb. 27, 1990

[54] METHOD OF PRODUCING STABLE MAGNETIC DOMAIN REFINEMENT OF ELECTRICAL STEELS BY METALLIC CONTAMINANTS

[75] Inventors: S. Leslie Ames, Sarver; Jeffrey M. Breznak, Springdale, both of Pa.

[73] Assignee: Allegheny Ludlum Corporation, Pittsburgh, Pa.

[21] Appl. No.: 205,711

[22] Filed: Jun. 10, 1988

[51] Int. Cl.[4] ..... H01F 1/04

[52] U.S. Cl. ..... 148/113; 148/122

[58] Field of Search ..... 148/111, 112, 113, 122

[56] References Cited

U.S. PATENT DOCUMENTS

| | | | |
|---|---|---|---|
| 3,932,235 | 1/1976 | Foster | 148/113 |
| 3,990,923 | 11/1976 | Takashina et al. | 148/111 |
| 4,655,854 | 4/1987 | Nishiike et al. | 148/111 |
| 4,750,949 | 6/1988 | Kobayashi et al. | 148/111 |

FOREIGN PATENT DOCUMENTS

| | | | |
|---|---|---|---|
| 0193324 | 3/1986 | European Pat. Off. . | |
| 61139679 | 11/1984 | Japan . | |
| 60-255926 | 12/1985 | Japan | 148/113 |
| 61-133321 | 6/1986 | Japan . | |
| 61-284529 | 12/1986 | Japan . | |
| 62-51202 | 3/1987 | Japan . | |
| 2167324A | 5/1988 | United Kingdom . | |

*Primary Examiner*—John P. Sheehan

*Attorney, Agent, or Firm*—Patrick J. Viccaro

[57] ABSTRACT

A method is provided for refining the magnetic domain wall spacing of grain-oriented silicon steel sheet having an insulation base coating thereon by removing portions of the base coating to expose a line pattern of the underlying silicon steel substantially transverse to the rolling direction of the steel, applying a metallic contaminant to the steel, the exposed steel being free of thermal and plastic stresses, and thereafter annealing the steel and contaminant thereon at time and temperatures of about 1400° F. or more in a protective atmosphere to diffuse sufficient and controlled amounts of the comtaninant into the steel to produce a permanent pore stable up to 2100° F. to effect heat resistant domain refinement and reduce core loss.

10 Claims, 2 Drawing Sheets

METHOD OF PRODUCING STABLE MAGNETIC DOMAIN REFINEMENT OF ELECTRICAL STEELS BY METALLIC CONTAMINANTS

BACKGROUND OF THE INVENTION

This invention relates to a method for improving core loss by refining the magnetic domain wall spacing of electrical sheet or strip products. More particularly, this invention relates to a method of processing final texture annealed grain-oriented silicon steels to effect heat resistant domain refinement using metallic contaminants.

Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110)[001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically of 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater than 0.400 watts per pound (WPP) at 1.5 Tesla at 60 Hertz for nominally 9-mil material. High permeability grain-oriented silicon steels are characterized by higher permeabilities which may be the result of compositional changes alone or together with process changes. For example, high permeability silicon steels may contain nitrides, sulfides, and/or borides which contribute to the precipitates and inclusions of the inhibition system which contributes to the properties of the final steel product. Furthermore, such high permeability silicon steels generally undergo cold reduction operations to final gauge wherein a final heavy cold reduction on the order of greater than 80% is made in order to facilitate the grain orientation. While such higher permeability materials are desirable, such materials tend to produce larger magnetic domains than conventional material. Generally, larger domains are deleterious to core loss.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes, generally spaced at regular intervals. The scribe lines are substantially transverse to the rolling direction and typically are applied to only one side of the steel.

In fabricating these electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA) is essential to restore usable properties. For such end uses there is a need for a flat, domain-refined silicon steel which need not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce much more worked stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

It has been suggested in prior patent art that contaminants or intruders may be effective in refining the magnetic domain wall spacing of grain-oriented silicon steel. U.S. Pat. No. 3,990,923 - Takashina et al., dated Nov. 9, 1976, discloses that chemical treatment may be used on primary recrystallized silicon steel to control or inhibit the growth of secondary recrystallization grains. British Patent Application No. 2,167,324A discloses a method of subdividing magnetic domains of grain-oriented silicon steels to survive an SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and nonmetals are identified as suitable intruder materials.

Japanese Patent Document No. 61-133321A discloses removing surface coatings from final texture annealed magnetic steel sheet, forming permeable material coating on the sheet and heat treating to form material having components or structure different than those of the steel matrix at intervals which provide heat resistant domain refinement.

Japanese Patent Document No. 61-139-679A discloses a process of coating final texture annealed oriented magnetic steel sheet in the form of linear or spot shapes, at intervals with at least one compound selected from the group of phosphoric acid, phosphates, boric acid, borates, sulfates, nitrates, and silicates, and thereafter baking at 300°–1200° C., and forming a penetrated body different from that of the steel to refine the magnetic domains.

Japanese Patent Document No. 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

Japanese Patent Document No. 62-51202 discloses a process for improving the core loss of silicon steel by removing the forsterite film formed after final finish annealing, and adhering different metal, such as copper, nickel, antimony by heating.

Copending application Ser. Nos. 206,051, filed June 10, 1988, and 206,152, filed June 10, 1988, by the Assignee of this invention discloses specific methods for refining the magnetic domain wall spacing of grain-oriented silicon steel using certain metal and nonmetal contaminants.

What is needed is a method for refining the magnetic domain wall spacing of grain-oriented silicon steel, having a forsterite base coating thereon, which is heat resistant. The method should be compatible with conventional processing of regular and high permeability silicon steels and should use the thermally insulative coating, i.e., the forsterite base coating, on the sheet to facilitate the domain refinement. Still further, the method should be useful with numerous techniques including conventional methods for removing the base coating in selected patterns.

SUMMARY OF THE INVENTION

In accordance with the present invention there is provided a method for refining the magnetic domain wall spacing of grain-oriented silicon steel sheet having an insulation base coating, the method which includes removing portions of the base coating to expose a line pattern of the underlying silicon steel, and applying a metallic contaminant to the silicon steel, the metallic contaminant may be selected from the group of copper, tin, nickel, zinc, antimony, combinations and compounds thereof. The exposed steel is free of thermal and plastic stresses and is not dependent on such stresses to be effectively domain refined. Thereafter the steel and contaminant thereon are annealed at time and temperature of 1400° F. or more in a protective atmosphere to diffuse sufficient and controlled amounts of contaminant into the exposed steel to produce lines of permanent pores to effect heat resistant domain refinement and reduced core loss in substantially stress-free steel.

DETAILED DESCRIPTION OF THE PREFERRED EMBODIMENTS

Figure 1:
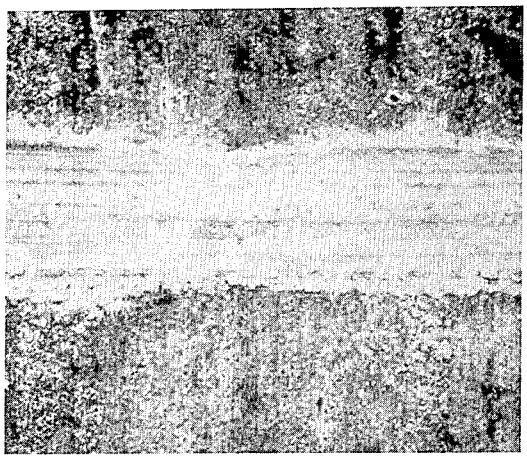
FIG. 1 is a photomicrograph of a copper-filled groove in the silicon steel base coating in accordance with the present invention.

Broadly, the method of the present invention relates to a method for refinement of the domain structure of grain-oriented silicon steel sheet having relatively large grain sizes by the controlled surface chemical contamination. The method takes final textured annealed silicon steel as the starting sheet material, having the electrically and thermally insulating base coating in place, and then by any of numerous techniques, locally removes the coating to expose the bare metal. No plastic strain or stress of any sort needs to be imposed on the metal and thereafter the exposed bare metal is contaminated by other materials on the areas of the exposed metal pattern. The steel is then annealed to diffuser alloy the contaminant into the iron-silicon steel sheet product. The resulting domain refinement is heat resistant as it survives stress relief annealing.

The starting material for the chemical striping process of the present invention is final textured annealed grain-oriented silicon steel having an insulative coating in place. Such an insulative coating can be the conventional base coating, also called forsterite or mill glass coating. Preferably, the as-scrubbed final texture annealed grain-oriented silicon steels may be used. Such steels may be of the regular or conventional grain-oriented silicon steels or of high permeability grain-oriented silicon steels. The particular compositions of such steels are not critical to the present invention and they may be conventional compositions. As used herein the steel melts initially contained the nominal composition as follows:

| | C | N | Mn | S | Si | Cu | B | Fe |
|---|---|---|---|---|---|---|---|---|
| Steel 1 | .030 | <50 ppm | .038 | .017 | 3.15 | .30 | 10 ppm | Bal. |

The steel is a high permeability grain-oriented silicon steel. As used herein, all compositions are by weight percent, unless otherwise specified.

The steel was produced by casting, hot rolling, normalizing, cold rolling to final gauge with an intermediate annealing when two or more cold rolling stages were used, decarburizing, coating with MgO, and final texture annealing to achieve the desired secondary recrystallization of cube-on-edge orientation. After decarburizing the steel, a refractory oxide base coating containing primarily magnesium oxide was applied before final texture annealing at elevated temperature; such annealing caused a reaction at the steel surface to create a forsterite base coating. Although the steel melts of the steel initially contained the nominal compositions recited above, after final texture annealing, the C, N, and S were reduced to trace levels of less than about 0.001% by weight.

In accordance with the present invention, it is important that portions of the coating be removed to expose a line or stripe pattern in the underlying silicon steel. How the coating is removed is not critical to the present invention except that the underlying steel need not be subjected to any mechanical, thermal, or other stresses and strains as a result of the coating removal operation. In other words, the exposed steel must be free of any thermal and plastic stresses prior to any subsequent steps of applying the metallic contaminant. An advantage of the present invention is that any of various techniques may be used to remove the selected portions of the base coating. For example, conventional mechanical scribing or laser means may be used to develop a controlled pattern of markings on the strip surface. The line or stripe pattern selected for the removed base coating may be conventional patterns used in prior art scribing techniques. Preferably, the pattern may comprise removing the coating in generally parallel lines substantially transverse to the rolling direction of the steel having a line width and spacing as may be conventional. Other patterns may also be useful, depending on whether the grain-oriented silicon steel is of the cube-on-edge, cube-on-face, or other orientation.

In accordance with the present invention, the exposed silicon steel would be plated or coated by selected metals and metal alloys. Preferably the metals are selected such that they have a diffusion rate slower than iron in silicon steels. The metals and metal alloys suitable for the present invention are referred to as contaminant or diffuser materials. As used herein, "contaminant" refers to those certain suitable metal and metal alloys selectively applied to the exposed areas of steel sheet in accordance with this invention. It has been found that various metallic contaminants may be used selected from the group of copper, tin, nickel, zinc, antimony, combinations and compounds thereof. The metallic contaminants may be applied as a coating to the silicon steel using various conventional means such as electroless deposition or electrolytic plating. Because of the insulative nature of the base coating, the metallic contaminant can only be applied in the selected line pattern or stripes which conform to the pattern of base coating removal. What is important at this point is that the base glass insulation on the silicon steel facilitates selective deposition of the metallic contaminant in the predetermined or preselected pattern.

The silicon steel having the selected portions of base coating removed and having the metallic contaminant applied is thereafter annealed at a time and temperature in a protective atmosphere to diffuse sufficient and controlled amounts of contaminant into the exposed steel to produce permanent pores to effect heat resistant domain refinement and reduced core loss. The annealing has the effect of a diffusion anneal to cause minor alloying of the metallic contaminant with the iron-silicon steel sheet to effect heat resistant domain refinement. The annealing temperature ranges from about 1400° F. (760° C.) or more and may range up to 2100° F. (1150° C.). Preferably, the temperatures range up to 1800° F. (982° C.) and more preferably, from about 1400 to 1700° F. (760° to 927° C.).

It is desirable that the anneal temperature be at least equal to or greater than the temperature that would normally be used for a stress relief anneal in order that the property effects developed would be stable with respect to any subsequent lower temperature treatment such as a stress relief anneal (SRA). In other words, the improvements in core loss would be the result of heat resistant domain refinement. The time for the anneal may range up to 20 hours and preferably may range from 30 minutes to 5 hours at a temperature sufficient to produce the magnetic domain refining. As a practical consideration, the diffusion anneal should be higher than a conventional stress relief anneal of about 1425° F. (774° C.) which may be used by transformer manufacturers following fabrication. Temperatures on the order of up to 1650° F. (899° C.) are sufficient to effect the heat resistant domain refinement without requiring an additional separator coating to prevent adjacent coil laps from thermally welding together during the annealing. Lower temperature anneals may also be successful.

As is known, substantially complete homogeneity is a highly desirable condition for soft magnetic materials. It has been found that proper time and temperature develops and stabilizes the permanent pores and further diffuses the contaminants into the steel to provide a substantially homogeneous steel sheet throughout the steel thickness. Generally, annealing at the higher temperatures facilitates homogeneity. For all annealing in accordance with the present invention, the strip may be annealed either in coil form or as a strand anneal of the continuously moving strip following the application of the metallic contaminant.

In order to better understand the present invention, the following examples are presented. Unless otherwise stated, the metallic contaminants used in the examples hereof were selected from the plating solutions described in Table I and were electrolytically plated.

TABLE I

| Plating Metal | Solutions and Conditions |
|---|---|
| Tin | Stannous Sulfate 80 gm/l |
| | Sulfuric Acid 52 ml/l |
| | Ambient Temperature |
| | Stainless or Tin Anodes |
| | *.125 A/in$^2$ (1.94 A/dm$^2$); 1 min. |
| Nickel | Nickel Sulfate 328 gm/l |
| | Nickel Chloride 60 gm/l |
| | Boric Acid 211 gm/l |
| | Temperature 130° F. |
| | Nickel Anodes |
| | *.25 A/in$^2$ (3.88 A/dm$^2$); 15–30 secs. |
| Copper | Copper Cyanide 24 gm/l |
| | Sodium Cyanide 39 gm/l |
| | Sodium Hydroxide 39 gm/l |
| | Ambient Temperature |
| | Copper Anodes |
| | *.25 A/in$^2$ (3.88 A/dm$^2$); 30–60 secs. |
| Zinc | Zinc Sulfate 375 gm/l |
| | Ammonium Chloride 16 gm/l |
| | Temperature 100° F. |
| | Stainless Anodes |
| | *.25 A/in$^2$ (3.88 A/dm$^2$); 30 secs. |
| Ni—Sn | Stannous Chloride 53 gm/l |
| | Nickel Chloride 328 gm/l |
| | Ammonium Bifluoride 62 gm/l |
| | Ammonium Hydroxide (to give pH 2.5) |
| | Temperature 150° F. |
| | Stainless or Nickel Anodes |
| | *0.2 A/in$^2$ (3.1 A/dm$^2$); 1½ mins. |
| Antimony | Antimony Oxide 60 gm/l |
| | Hydrofluoric Acid (48%) 120 ml/l |
| | Beta-napthol 1 eyedrop/l |
| | Ambient Temperature |
| | Stainless Anodes |

TABLE I-continued

| Plating Metal | Solutions and Conditions |
|---|---|
| | *.07 A/in$^2$ (1.09 A/dm$^2$); 2 mins. |

*Current density pertains to total strip area.

EXAMPLE I

Two Epstein packs of nominally 8-mil high permeability grain-oriented silicon steel sheet described were mechanically scribed in the as-scrubbed condition. The scribing effectively removed portions of the base coating in a pattern of substantially parallel lines substantially transverse to the rolling direction of the steel strip. Each Epstein pack had twelve (12) strips, and each strip was 3 cm wide and had the scribe lines spaced at about 5 mm intervals. Immediately following the mechanical scribing, a stress relief anneal at 1500° F. (816° C.) for two hours was performed. The samples were then electrolytically plated with copper using the copper solution described in Table I and subsequently annealed at 1650° F. (899°) for 5 hours in a protective atmosphere to diffuse the metallic contaminant into the silicon steel sheet body. Percentages in parentheses indicate change compared to initial properties. The magnetic properties were determined in a conventional manner for Epstein packs.

TABLE II

| Epstein Pack | Initial As-Scrubbed | | | Mechanically Scribed | | | 2 hr. at 1500° F. Stress-Relief Anneal | | | Chemically-Striped (Copper) + 1650°/5 hr. Anneal | | |
|---|---|---|---|---|---|---|---|---|---|---|---|---|
| | Permeability @ 10 H | Core Loss @ 1.5 T (wpp) | Core Loss @ 1.7 T (wpp) | Permeability @ 10 H | Core Loss @ 1.5 T (wpp) | Core Loss @ 1.7 T (wpp) | Permeability @ 10 H | Core Loss @ 1.5 T (wpp) | Core Loss @ 1.7 T (wpp) | Permeability @ 10 H | Core Loss @ 1.5 T (wpp) | Core Loss @ 1.7 T (wpp) |
| B | 1935 | .417 | .561 | 1932 | .359 | .489 | 1935 | .416 | .559 | 1933 | .388 (−7%) | .525 (−6%) |
| C. | 1938 | .416 | .556 | 1935 | .356 | .481 | 1937 | .410 | .551 | 1936 | .391 (−6%) | .529 (−5%) |

As shown by the data in Table II, the mechanical scribing resulted in some core loss improvement, as would be expected, resulting from some plastic deformation damage to the underlying silicon steel. Such improvement was not thermally stable and after the 1500° F. (816° C.) stress relief anneal the plastic deformation was removed and the properties returned substantially to their initial unscribed values of the base-coated final texture annealed silicon steel. The steel exhibited only the pattern of exposed underlying metal. The chemical striping treatment in accordance with the present invention with copper followed by the diffusion anneal at 1650° F. (899° C.) shows a significant core loss improvement averaging about 6% and clearly demonstrates the chemical striping of the present invention can be effective independent of any plastic or thermal stress or deformation of the steel. Furthermore, following a subsequent stress relief anneal at 1450° F. (788° C.) for 2 hours, the samples demonstrate a permanent core loss improvement indicating a heat-resistant domain refinement in each sample. Such samples confirm that thermal or plastic deformation of the exposed silicon steel plays no role in heat resistant domain refinement.

Figure 2:
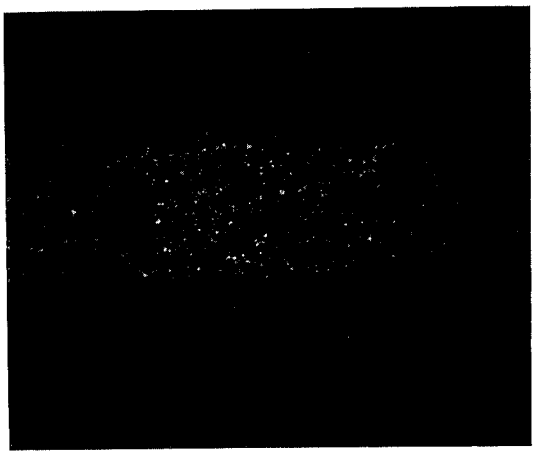
FIG. 2 is a 150× photograph of an X-ray map of copper of FIG. 1.
Figure 3:
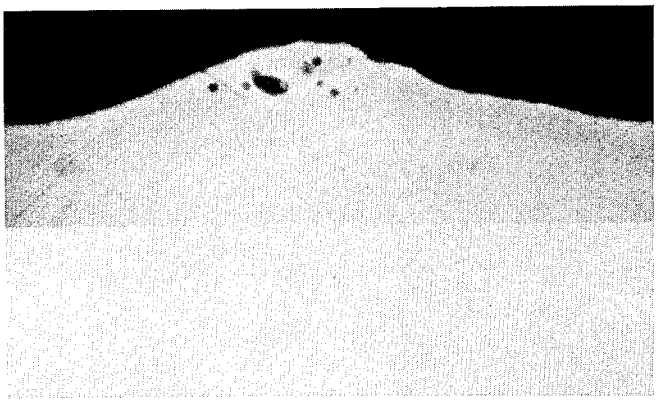
FIG. 3 is a 3000× photomicrograph of a silicon steel after diffusion anneal showing porosity in accordance with the present invention.

FIG. 1 is a Scanning Electron Microscope photomicrograph of a groove, i.e., the silicon steel exposed through the base coating, filled with copper after plating the sample with copper. FIG. 2 is a 150× photograph of an x-ray map showing copper in the line pattern of the silicon steel sample.

EXAMPLE II

Single-strip Epstein samples 8 mils thick by 3 cm wide of the steel composition of Example I were subjected to a chemical pickling in HCl-1% HF acid to remove all of the insulative base coating from the texture annealed strips. A plastic stencil with slits was attached to the steel surface, such that the pattern of slits formed substantially parallel lines substantially transverse to the rolling direction of the steel strip as in Example I. Each sample with the stencil thereon was electroplated with copper as described in Example I, and then annealed at 1650° F. (899° C.) for 2 hours (with the stencil removed) to diffuse the metallic contaminant into the silicon steel body. Percentage in parentheses indicates change compared to original properties. The magnetic properties were determined in a conventional manner for single strip tests.

TABLE III

| Sample No. | Original Properties | | | Chemically-Striped with copper + 2 hr./1650° F. anneal | | |
|---|---|---|---|---|---|---|
| | Permeability @ 10 H | Core Loss @ 1.5 T | Core Loss @ 1.7 T | Permeability @ 10 H | Core Loss @ 1.5 T | Core Loss @ 1.7 T |
| 160/163/9 | 1912 | .437 | .544 | 1913 | .385 (−12%) | .525 (−3%) |
| 160/163/10 | 1935 | .449 | .579 | 1946 | .422 (−6%) | .567 (−2%) |
| 160/163/11 | 1921 | .495 | .634 | 1939 | .442 (−11%) | .587 (−8%) |

Results shown in Table III show considerably improved properties of core loss after the diffusion anneal although the samples at no stage were subjected to a plastic deformation or stress. The improved properties demonstrate unequivocally that plastic deformation plays no role in domain refining by chemical striping in accordance with the present invention.

A metallographic examination of various samples in the diffusion-annealed zone showed no extensive attack of the substrate steel by the plated deposit which is consistent with the small amount of contaminant deposited and the relatively low diffusion temperatures used. Structures at high magnification tended to be varied and complicated as is not unusual in diffusion-couple metallurgy. The data suggest that the domain refinement of the present invention is not dependent on development and/or preservation of subtle composition gradients within the chemically striped or treated region. Rather, it appears that the effect is the Kirkendall porosity phenomenon which is well known in diffusion-couple metallurgy. Although there is no intent to be bound by theory, the Kirkendall related mechanism appears to suggest that contaminants of a different chemical nature can be successfully used as chemical stripe contaminants and that the precise chemical character is not as important as the diffusion rate with respect to the iron base material. Furthermore, in keeping with Kirkendall diffusion theory, it appears that lower diffusion temperatures would tend to exaggerate the Kirkendall porosity and that preferably the subsequent annealing should preferably occur within the low range of 1400° to 1700° F. (760° to 927° C.).

EXAMPLE III

Single strips of a high permeability grain-oriented silicon steel of the steel described above were mechanically scribed or in some cases electrically discharge scribed in the as-scrubbed condition. The scribing effectively removed portions of the base coating in a pattern of substantially parallel lines substantially transverse to the rolling direction of the steel strip. The lines were about 3 mm wide on single strip 8-mil Epstein samples and spaced at about 5 mm intervals. The samples were then electrolytically plated with various metallic contaminants from the plating solutions listed in Table I. The plating resulted in the grooves in the base coating being at least half filled with the metallic contaminant, as judged under a microscope. After plating, the samples were diffusion annealed as indicated in a substantially hydrogen atmosphere.

TABLE IV

| | Original Properties | | | Chemically-Striped | | | | Anneal | |
|---|---|---|---|---|---|---|---|---|---|
| | | Core Loss | | | Core Loss | | | | |
| Sample No. | Permeability @ 10 H | @ 1.5 T (wpp) | @ 1.7 T (wpp) | Permeability @ 10 H | @ 1.5 T (wpp) | @ 1.7 T (wpp) | Metal | Time (hrs) | Temperature (°F.) |
| B13 | 1875 | .447 | .658 | 1875 | .433 | .644 | Sn | 4 | 1475 |
| B15 | 1911 | .448 | .649 | 1910 | .406 | .590 | Sn | 4 | 1475 |
| B16 | 1899 | .448 | .641 | 1896 | .410 | .610 | Sn | 4 | 1475 |
| P1-10 | 1865 | .473 | .721 | 1885 | .455 | .644 | Ni | 1 | 1600 |
| P1-11 | 1858 | .496 | .766 | 1849 | .476 | .733 | Ni | 1 | 1600 |
| P1-12 | 1893 | .494 | .712 | 1829 | .480 | .650 | Ni | 3 | 1600 |
| D-3 | 1909 | .434 | .610 | 1902 | .398 | .593 | Sb | 6 | 1650 |
| D-4 | 1910 | .471 | .694 | 1911 | .459 | .670 | Sb | 6 | 1650 |
| D-5 | 1918 | .455 | .668 | 1911 | .442 | .653 | Sb | 6 | 1650 |
| D-6 | 1914 | .424 | .674 | 1911 | .439 | .631 | Sb | 6 | 1650 |
| K-2 | 1912 | .441 | .655 | 1911 | .417 | .627 | Zn | 3.5 | 1650 |
| K-3 | 1908 | .416 | .568 | 1907 | .389 | .564 | Zn | 3.5 | 1650 |
| K-12 | 1933 | .418 | .586 | 1924 | .390 | .551 | Zn | 3.5 | 1650 |
| K-16 | 1923 | .432 | .607 | 1923 | .393 | .584 | Zn | 3.5 | 1650 |
| J-18 | 1916 | .394 | .534 | 1914 | .380 | .519 | Ni—Sn | 3.5 | 1650 |
| K-5 | 1893 | .400 | .593 | 1892 | .376 | .546 | Ni—Sn | 3.5 | 1650 |
| K-14 | 1920 | .414 | .579 | 1921 | .375 | .520 | Ni—Sn | 3.5 | 1650 |
| L-7 | 1914 | .423 | .613 | 1914 | .396 | .546 | Ni—Sn | 3.5 | 1650 |

As the data show in Table IV, for the tin, nickel, and antimony contaminants provided by the plating solutions and conditions set forth in Table I, the steels exhibited improvement in core loss properties at both 1.5 and 1.7 Tesla with little or no loss in permeability. Since the samples were heated at temperature above typical 1425° F. stress relief annealing, the core loss improvements were permanent with respect to heating at that temperature. In other words, the improvements were "heat proof."

EXAMPLE IV

Additional samples were tested to measure the thermal stability of the magnetic properties of samples treated in accordance with the present invention. If the magnetic property improvement is a result of Kirkendall porosity, then these improvements should exhibit exceptional stability. All of the samples are 8 or 12 strip Epstein packs. Each strip of nominally 8-mil steel of composition of Example I, was prepared by lightly mechanically scratching through the thin base glass to expose bare steel and was electroplated with the metals shown in Table V with lines about 0.25 mm wide and spaced at about 5 mm intervals. The strips were then stacked and then annealed at 1650° F. for 5 hours for diffusion. A considerable improvement in core loss properties was evident. The Epstein packs were then subjected to a further anneal at 2100° F. (1150° C.) for 2 hours or 10 hours, as indicated. Percentages in parentheses indicate change compared to initial properties.

TABLE V

| | Initial Properties | | | Chemically-Striped with 1650° F./5 hr. Anneal | | | After Further Anneal at 2100° F. | | |
|---|---|---|---|---|---|---|---|---|---|
| | | Core Loss | | | Core Loss | | | Core Loss | |
| Sample No. | Permeability @ 10 H | @ 1.5 T (wpp) | @ 1.7 T (wpp) | Permeability @ 10 H | @ 1.5 T (wpp) | @ 1.7 T (wpp) | Permeability @ 10 H | @ 1.5 T (wpp) | @ 1.7 T (wpp) |
| Zinc Stripe | | | | | | | | | |
| 160-6/3 | 1931 | .420 | .590 | 1930 | .378 (−10%) | .519 (−12%) | **1912 | .369 (−12%) | .508 (−14%) |
| Nickel-Tin Stripe | | | | | | | | | |
| 160-6/4 | 1916 | .414 | .588 | 1929 | .369 (−11%) | .506 (−14%) | **1911 | .370 (−11%) | .511 (−13%) |
| Copper Stripe | | | | | | | | | |
| 160-6/1 | 1920 | .422 | .577 | 1926 | .369 (−13%) | .494 (−14%) | **1916 | .381 (−10%) | .513 (−11%) |
| W | 1926 | .435 | .584 | 1918 | .393 (−10%) | .530 (−9%) | *1977 | .406 (−7%) | .547 (−6%) |
| X | 1926 | .428 | .572 | 1885 | .395 (−9%) | .551 (−4%) | *1923 | .414 (−3%) | .551 (−4%) |

TABLE V-continued

| Sample No. | Initial Properties | | | Chemically-Striped with 1650° F./5 hr. Anneal | | | After Further Anneal at 2100° F. | | |
|---|---|---|---|---|---|---|---|---|---|
| | Permeability @ 10 H | Core Loss @ 1.5 T (wpp) | Core Loss @ 1.7 T (wpp) | Permeability @ 10 H | Core Loss @ 1.5 T (wpp) | Core Loss @ 1.7 T (wpp) | Permeability @ 10 H | Core Loss @ 1.5 T (wpp) | Core Loss @ 1.7 T (wpp) |
| Y | 1908 | .460 | .629 | 1896 | .413 (−10%) | .569 (−10%) | *1909 | .425 (−8%) | .583 (−7%) |
| Z | 1921 | .474 | .626 | 1874 | .410 (−14%) | .591 (−6%) | *1915 | .417 (−12%) | .562 (−10%) |

**Sample annealed 10 hrs. at 2100° F.
*Sample annealed 2 hrs. at 2100° F.

The data and results of Table V show that the core loss improvement persisted up to 2100° F. which demonstrates the unique and exceptional stability of the domain refining of the present invention. Furthermore, the Scanning Electron Microscope (SEM) chemical analysis by X-ray showed that the previously chemical striped areas were now of the same composition as the matrix steel. In other words, the high temperature had homogenized the strip and the contaminant was no longer localized but part of the overall residual impurity in the bulk of the sample. The homogeneity and low stress state of the soft magnetic material is a desired result.

In view of the discoveries of the present invention, it is believed that the metal contaminants chosen will perform as expected if the diffusion rates are slower than the self-diffusion rate of iron in the ferrous base alloy. Furthermore, the slower the rate of the diffusion through iron, the more suitable the metal may be as a contaminant to produce the permanent porosity. For example, copper is on the order of 4 times slower than iron in diffusion through iron. Nickel is on the order of 500 times slower. Such metallic elements having slower diffusion rates in iron should result in the Kirkendall porosity phenomenon and the benefits of the present invention.

As was the object of the present invention, a method has been developed for providing heat resistant domain refinement which is compatible with conventional silicon steel processing. Such method can be used in conjunction with any of the numerous techniques for removing patterned lines of the base coating of final texture annealed material and is particularly useful on steel which is free from thermal and plastic strains in the region of the selected striping pattern to effect domain refinement. Such magnetic improvements are thermally stable up to about 2100° F.

Although preferred and alternative embodiments have been described, it should be understood that variations and modifications may be made without going outside the scope of the invention.

What is claimed is:

1. A method for refining the magnetic domain wall spacing of grain-oriented silicon steel sheet having an insulation base coating thereon, the method comprising:
   removing portions of the base coating to expose a line pattern of the underlying silicon steel;
   applying a metallic contaminant to the exposed silicon steel, the metallic contaminant having a diffusion rate slower than iron in the silicon steel, the exposed steel being free of thermal and plastic stresses;
   thereafter annealing the steel and contaminant thereon at time and temperature of 1400° F. or more in a protective atmosphere to diffuse sufficient and controlled amounts of contaminant into the exposed steel to produce lines of permanent pores stable up to 2100° F. to effect heat resistant domain refinement and reduced core loss of substantially stress-free steel.

2. The method of claim 1 wherein the step of annealing the steel and contaminant thereon includes at time and temperatures up to 1000° F.

3. The method of claim 1 wherein the step of annealing the steel and contaminant thereon includes at time and temperature of about 1400° to 1700° F. to develop and stabilize the permanent pores.

4. The method of claim 1 wherein the step of annealing the steel and contaminant thereon includes at time and temperatures up to 2100° F. to further diffuse the contaminants into the steel to provide a substantially homogeneous steel sheet throughout the steel thickness.

5. The method of claim 1 wherein the step of applying the metallic contaminant includes applying the contaminant at least in the areas of exposed steel.

6. The method of claim 1 wherein the metallic contaminant is selected from the group of copper, tin, nickel, zinc, antimony, combinations and compounds thereof.

7. The method of claim 1 wherein the step of annealing uses a protective atmosphere selected from hydrogen, nitrogen, and mixtures thereof.

8. The method of claim 1 wherein prior to the step of annealing the silicon steel having the metallic contaminant thereon, the method includes fabricating the semi-finished sheet product into an article of manufacture and thereafter annealing to effect heat resistant domain refinement and reduced core loss.

9. The method of claim 1 wherein the pattern of lines extends substantially transverse to the rolling direction of the steel.

10. A method of refining the magnetic domain wall spacing of grain-oriented silicon steel sheet having an insulation base coating thereon, the method comprising:
   removing portions of the base coating to expose a line pattern of the underlying silicon steel;
   thereafter applying a metallic contaminant to the exposed silicon steel, the metallic contaminant selected from the group of copper, tin, nickel, zinc, antimony, combinations and compounds thereof, the exposed steel being free of thermal and plastic stresses;
   thereafter annealing the steel and contaminant thereon at time and temperature of about 1400° to 2100° F. in a protective atmosphere to diffuse sufficient and controlled amounts of contaminant into the exposed steel to provide a substantially homogeneous steel sheet throughout its thickness having developed stable pores in the line pattern to effect heat resistant domain refinement and reduced core loss in a substantially stress-free sheet.

* * * * *